United States Patent [19]

Triplett

[11] 4,359,164

[45] Nov. 16, 1982

[54] FLOATING CRANE APPARATUS

[76] Inventor: James T. Triplett, P.O. Box 488, Chester, S.C. 29706

[21] Appl. No.: 72,347

[22] Filed: Sep. 4, 1979

[51] Int. Cl.[3] ..... B66C 23/52

[52] U.S. Cl. ..... 212/182; 212/192; 114/264

[58] Field of Search ..... 212/175, 182, 189, 190, 212/191, 192, 245; 114/264, 266; 9/8 P; 405/204

[56] References Cited

U.S. PATENT DOCUMENTS

| | | | |
|---|---|---|---|
| 3,645,405 | 2/1972 | Stiglich | 212/182 |
| 4,166,426 | 9/1979 | Lloyd | 114/264 |

FOREIGN PATENT DOCUMENTS

| | | | |
|---|---|---|---|
| 336224 | 9/1917 | Fed. Rep. of Germany | 212/190 |
| 6408555 | 1/1965 | Netherlands | 212/190 |

*Primary Examiner*—Robert W. Saifer

*Attorney, Agent, or Firm*—Dority & Flint

[57] ABSTRACT

A floating crane apparatus is disclosed as including an annular float assembly comprising individual pontoon members detachably connected and interconnecting frame means which includes a bridge spanning a central opening in the annular float assembly by which a boom is operatively carried wherein the frame means includes foldable arms which may be folded with the pontoon members detached and nested beneath the bridge means to provide a configuration in which the floating crane apparatus may be transported. Propulsion means rotates the annular float assembly in a self-leveling manner to swing the boom laterally with reduced side loading.

12 Claims, 10 Drawing Figures

FLOATING CRANE APPARATUS

BACKGROUND OF THE INVENTION

Heretofore, floating cranes have been provided for building bridges, loading and unloading from docks, etc., which have typically included a rectangular barge structure upon which a crane structure is carried. Such rectangular barges typically range up to 200 feet in length and 50 feet in width, accommodating booms up to 300 feet in length. These structures have the disadvantage that the rectangular configuration and structure displaces a considerable amount of water requiring that a considerable amount of water be moved during maneuvers. When the crane boom swings laterally, the end of the barge loaded by the boom dips into the water placing side loads on the boom which, under certain severe conditions, can cause collapse of the boom. The resulting careening or listing of the barge to one side, as the boom swings, makes accurate positioning of the boom difficult and makes the whole structure out of level. Waves from natural causes or from passing of even a small yacht can cause considerable lift and side loading of the boom structure. Furthermore, the rectangular floating crane structure cannot be closely positioned to an obstacle during use since it is awkward and cannot be maneuvered in close without a dangerous likelihood of striking the obstacle.

Boom lengths have been limited on rectangular barges since the problems of maintaining the floating apparatus level and boom side loading increase with the length of the boom.

SUMMARY OF THE INVENTION

It has been found that a floating crane structure affording reduced side loading of the longitudinal boom and increased maneuverability in close proximity to an obstacle yet affording easy transportation between job locations may be had by providing a plurality of pontoon members detachably connected with one another and a truss frame interconnecting the pontoon members providing a self-leveling annular float assembly which includes a bridge extending between forward and aft pontoon members by which a boom is operatively carried whereby the boom may be moved laterally by propelling the annular float assembly about a central anchor pivot and wherein the individual pontoon members may be detached and nested between the forward and aft pontoon members with pivotable arms of the frame being folded facilitating transportation of the floating crane structure.

Accordingly, an important object of the present invention is the provision of a floating crane structure in which side loading of the boom is substantially reduced during lateral movements of the load.

Yet another important object of the present invention is to provide a floating crane structure having an annular float assembly which requires very little water movement during crane maneuvers and is essentially self-leveling and unaffected by wave movement.

Yet another important object of the present invention is an annular floating crane structure which provides a highly stable float platform and includes a plurality of individual pontoon members which may be disassembled and nested between forward and aft pontoons with supporting framework folded providing a transport configuration passable through narrow canals, rivers, bridges, and the like.

Yet another important object of the present invention is to provide a floating crane structure which can be positioned and maneuvered in close to an obstacle reducing the dangerous likelihood of striking the obstacle.

Still another important object of the present invention is the provision of an annular floating crane apparatus wherein the float assembly and boom rotate as a unit in a self-leveling manner essentially without moment rather than swinging the boom on a relatively stationary floating structure thereby reducing side loading.

BRIEF DESCRIPTION OF THE DRAWINGS

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
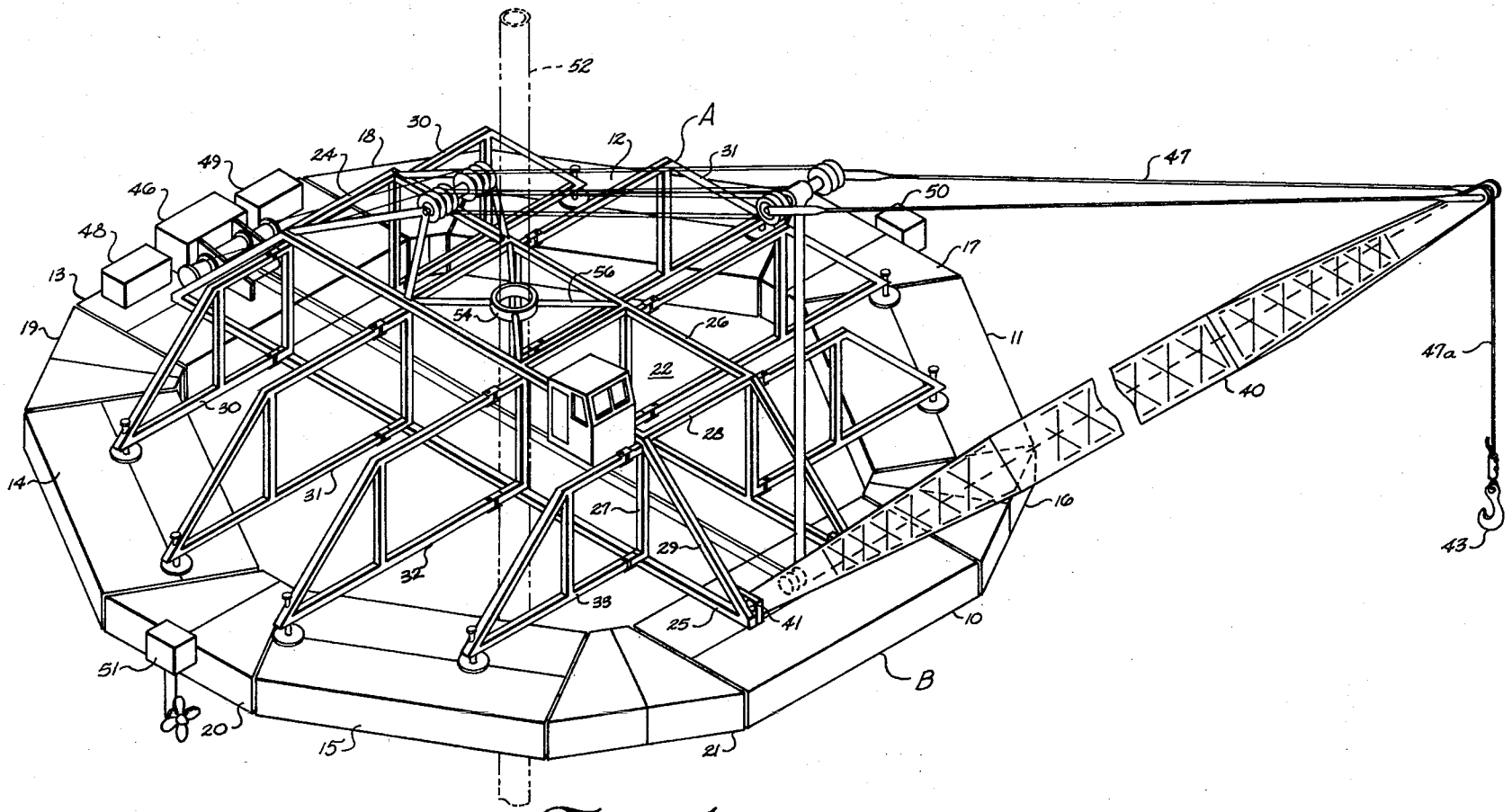
FIG. 1 is a perspective view of a floating crane structure according to the invention.

The drawings illustrate floating crane apparatus for supporting and moving a load including a plurality of pontoon members having detachable connection with one another and frame means A interconnecting the pontoon members in an annular configuration to provide an annular float assembly B having a medial opening therein. A bridge means is included in the frame means extending generally between forward and aft pontoon members spanning the medial opening. Longitudinal boom means is carried by the annular float assembly and operatively carried by the bridge means for vertical pivotal movement. An anchor pivot means carried by the annular float assembly adjacent the medial opening provides a pivot about which the annular float assembly turns. Propulsion means carried by the annular float assembly produces a rotational thrust for rotating the float assembly about the anchor pivot. The frame means A include movable arm members having a first position in which they are connected to the pontoon members structurally maintaining the annular configuration and a second position in which a number of the pontoon members are nested between the forward and aft pontoon members with the arm members folded facilitating transportation of the floating crane apparatus. A load supported by the longitudinal boom means may be moved with reduced side loading of the boom during lateral movements since the boom is not rotating relative to a stationary floating barge but rather as a unit with the annular float assembly rotating in a self-leveling manner.

Referring now in more detail to the drawings, the annular float assembly is illustrated as including main pontoon members 10, 11, 12, 13, 14, and 15; and intermediate pontoon members 16, 17, 18, 19, 20, and 21. Main pontoon members 10 and 13 serve as forward and aft pontoon members, respectively. The remaining main pontoon members serve as side pontoons. As illustrated, the main pontoon members 10 through 15 are tubular in form having a rectangular cross section. Intermediate pontoon members are tubular having a truncated pie shape of reducing rectangular cross section so as to connect with the main pontoon members to create the annular configuration of the float assembly as illustrated, with a medial portion 22 being open. In a preferred embodiment, an annular float assembly approximately 130 feet in diameter is utilized. The individual pontoon members may be detachably connected by any suitable means such as a flange and pin connection including flange means 23 and 23*a* carried on respective pontoon mating ends and connecting pin 23*b*. Intermediate pontoons are provided in two separable halves for purposes hereinafter described, which may also be so connected.

The frame means A is illustrated as including bridge means 24 in the form of a truss bridge extending between the forward and aft pontoon members 10 and 13 spanning medial opening 22. Bridge means 24 may be of a welded construction and include longitudinal base spans 25, longitudinal top spans 26, vertical supports 27, horizontal supports 28, and inclined truss members 29. Carried by bridge 24 are a plurality of foldable arm members 30, 31, 32, and 33 extending from each side of the bridge.

Figure 2:
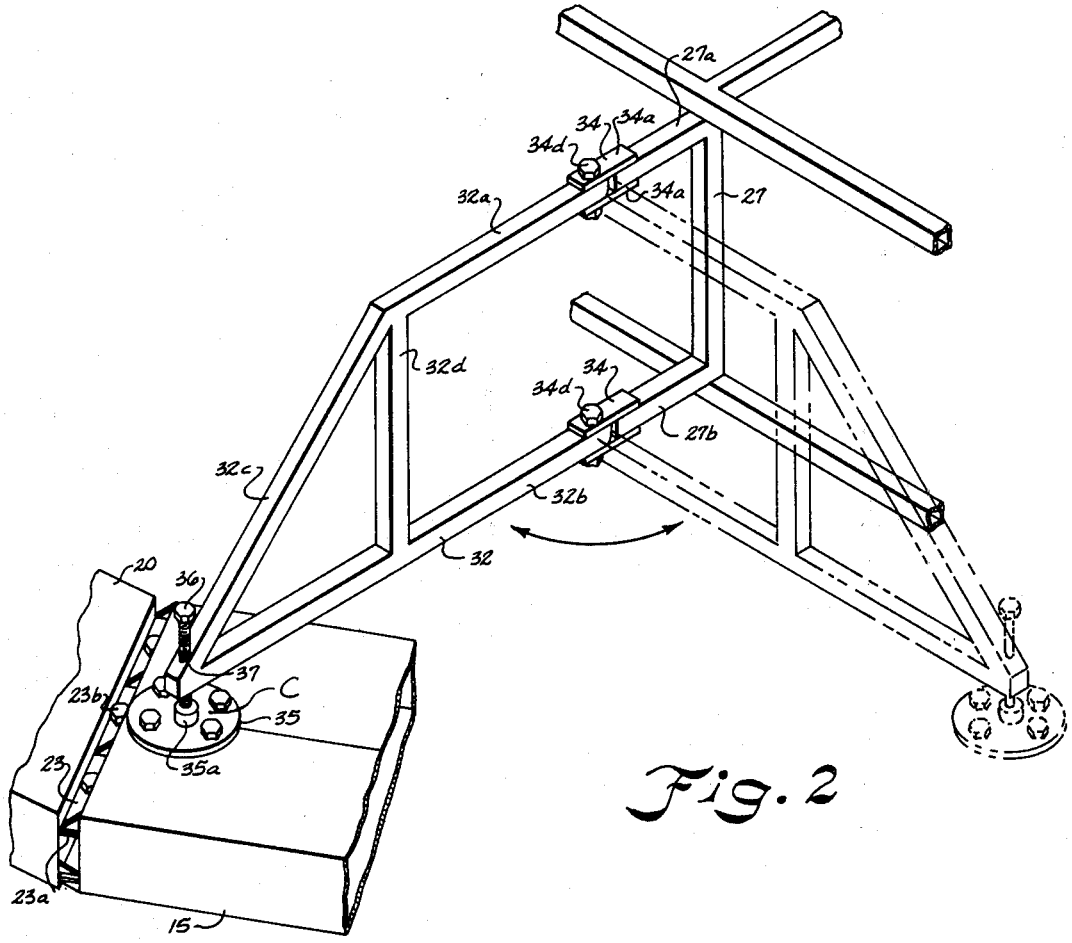
FIG. 2 is a perspective view with parts cut away illustrating the foldable truss arm assembly and leveling connection for floating crane apparatus constructed according to the invention.
Figure 3:
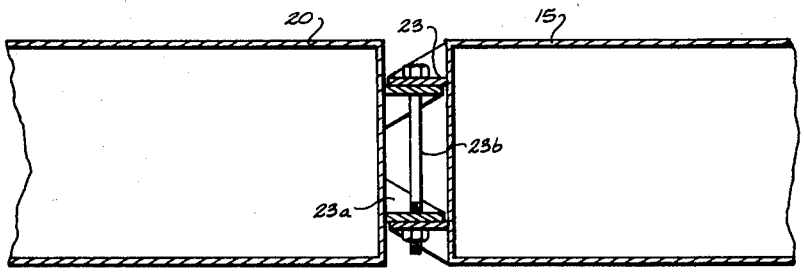
FIG. 3 is a section view in elevation illustrating a detachable connection between adjacent pontoon members according to the invention.
Figure 4:
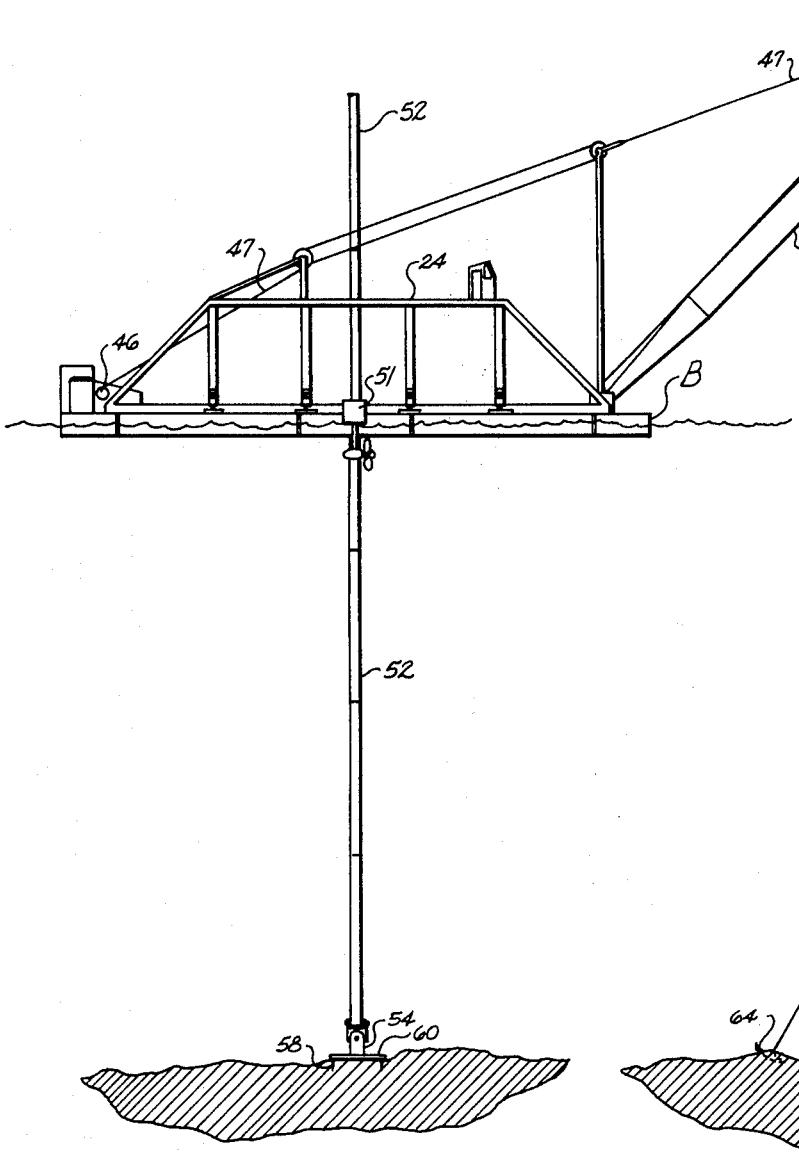
FIG. 4 is an elevational view illustrating the floating crane apparatus and spud anchor assembly according to the invention.
Figure 5:
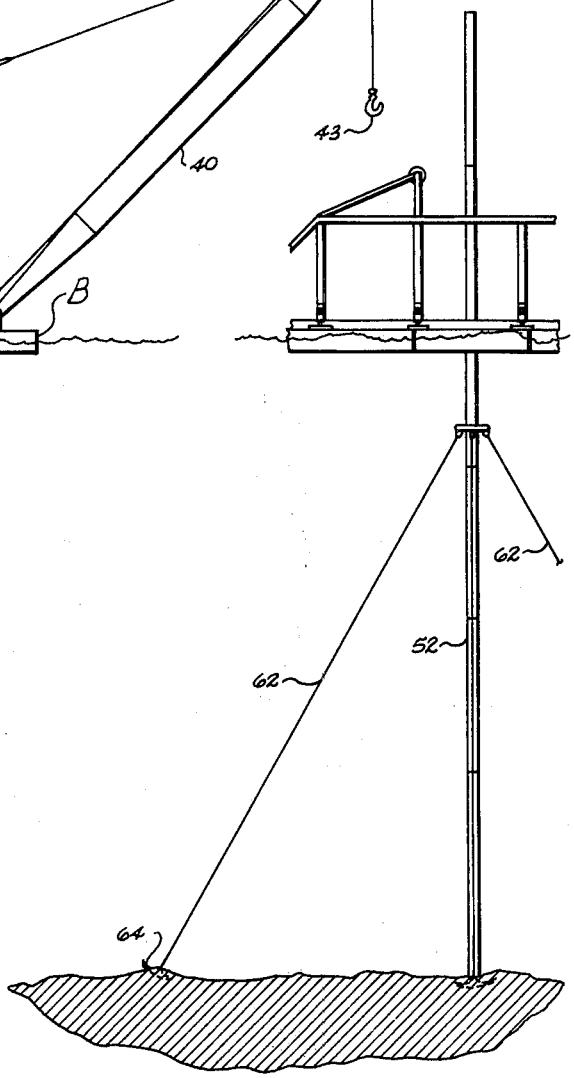
FIG. 5 is an elevational view illustrating the floating crane apparatus and spud anchor assembly according to the invention.
Figure 6:
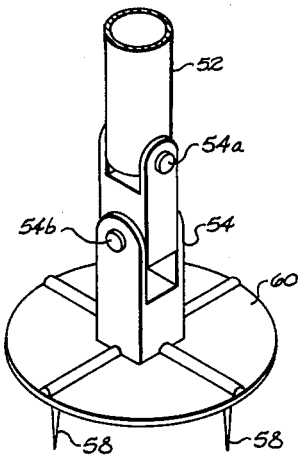
FIG. 6 is a perspective view illustrating a universal coupling and an anchor plate for a spud anchor assembly according to the invention.

Each foldable arm is carried by a pivot connection 34 as may best be seen in FIG. 2. Each movable arm includes, in reference to arm 32, an upper horizontal member 32*a*, a lower horizontal member 32*b*, inclined member 32*c* and vertical support 32*d* which may be made integral by welding. Pivot connection 34 includes arms 34*a* fixed to the free ends of posts 27*a* and 27*b* extending outwardly from vertical support 27 of frame means A. The movable arm 32*a* is then affixed by means of pivot pin 34*d* to the respective plates.

The free end of each movable arm is connected to the respective pontoon member by means of leveling connection means C. As illustrated in FIG. 2, the leveling connection means may be, in its simplest form, provided by a foot plate 35 bolted onto the pontoon member. A threaded member 36 is threadably received in a threaded opening 37 formed in the free end of arm member 32. One end of member 36 is journaled for rotation in the hub 35*a* of the connecting plate 35 to rotate freely but being retained therein. Thus, by rotating the screw 36, the arm 32 will be raised and lowered relative to the pontoon member 15 varying the thrust of the truss arm on the pontoon by which the attitude of the crane may be adjusted and leveled in the water. It is to be understood that other leveling connection means such as hydraulic cylinders may be utilized to raise and lower the arms relative to the pontoon members thereby adjusting the level of the pontoon members and attitude of the crane relative to the water.

Boom means is provided by a longitudinal boom and hoist 40 which is pivotably attached to the bridge and frame means A at 41 for movement in a vertical plane. Conventional block and tackle and cable arrangements may be provided for raising and lowering the boom 40 as well as for a load suspended from hook 43 by means of a conventional winch assembly 46 and boom cable 47 actuated by conventional hydraulic supply and actuator unit 48. Similarly, the load may be raised and lowered by a hoist cable 47*a* by winch assembly 46 actuated by hydraulic supply and actuator unit 49 in a conventional manner. Additional masts and supports may be provided for the boom as is necessary in a conventional manner.

Propulsion means are provided by hydraulic motors 50 and 51 for rotating the annular float assembly thereby moving the boom and load supported thereby laterally. Hydraulic motors 50 and 51 are carried by respective intermediate pontoon members 17 and 20 in any suitable manner and may be actuated conventionally by hydraulics.

Anchor pivot means is illustrated as including a spud anchor having a vertical post 52 carried in a loose fitting collar 54 which is integral with bridge 24 by means of integral welded cross members 56. The post 52 is fitted loosely for sliding movement in the collar 54. Spud blades 58 are carried on a plate 60 which is connected to the post 52 by means of a universal type coupling 54 whereby the blades 58 are allowed to engage the ground upon striking an uneven surface. Universal type coupling 54 provides two degrees of freedom about pivot axes 54*a* and 54*b* but will not allow the post to rotate.

Spud post 52 may be provided by a three foot diameter steel shell which is partially filled with concrete so as to give it weight whereby the spud blades 58 will be imbedded in the bottom when the post is dropped from a sufficient distance. With the spud blades locked in the mud on the bottom, the vertical post is locked against rotation providing a pivot about which annular float assembly B may rotate. Other types of attachments may be made to the end of vertical post 52 depending on the type terrain in which the crane apparatus is utilized. In some applications, it may be desirable to utilize cables 62, such as depths in excess of three hundred feet, whereby preferably four cables equally spaced are utilized to tie off the spud by utilizing conventional anchors 64.

Figure 7:
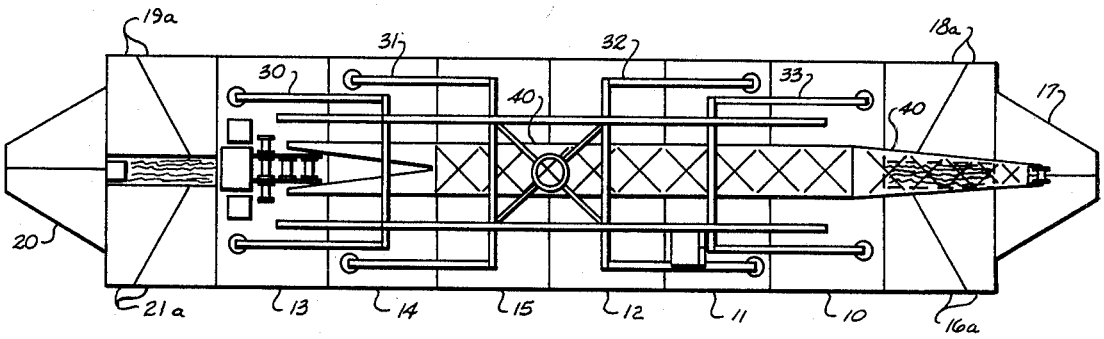
FIG. 7 is a top plan view of floating crane apparatus according to the invention in a folded configuration for transportation.
Figure 8:
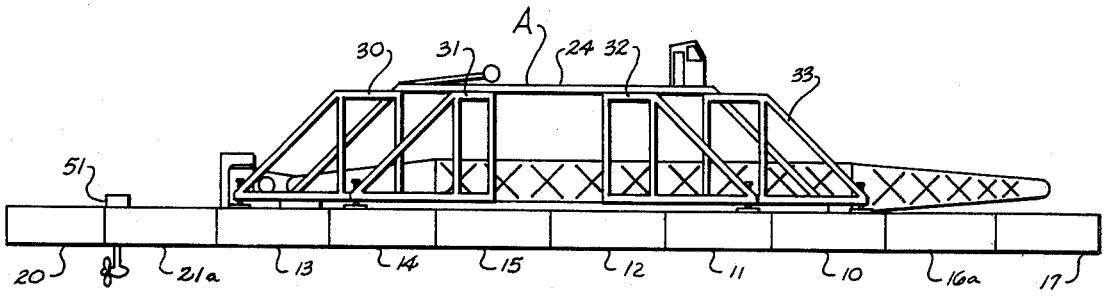
FIG. 8 is an elevation of the floating crane apparatus of the present invention in the folded configuration.

Referring now to FIGS. 7 and 8, the floating crane assembly is illustrated in a folded configuration wherein the movable arm members 30–33, are folded inwardly and attached to the main side pontoon members which are nested between the forward and aft pontoon members. The arms may be attached by means of screws 36 and foot plates 35 correspondingly attached to the nested pontoons. As illustrated, the intermediate pontoon members 16, 18, 19 and 21 are separated into pairs 16*a*, 18*a*, 19*a*, and 21*a* which are arranged in the folded configuration as can best be seen in FIG. 7. Intermediate pontoon members 17 and 20 are arranged as illustrated with the hydraulic motors positioned to provide a linear thrust for moving the folded crane apparatus between locations. Steering may also be provided by the hydraulic motors in this position. Boom 40 may be removed and nested under bridge 24. Connection of the intermediate pontoons in the folded configuration illustrated may be had in any suitable conventional manner.

Figure 9:
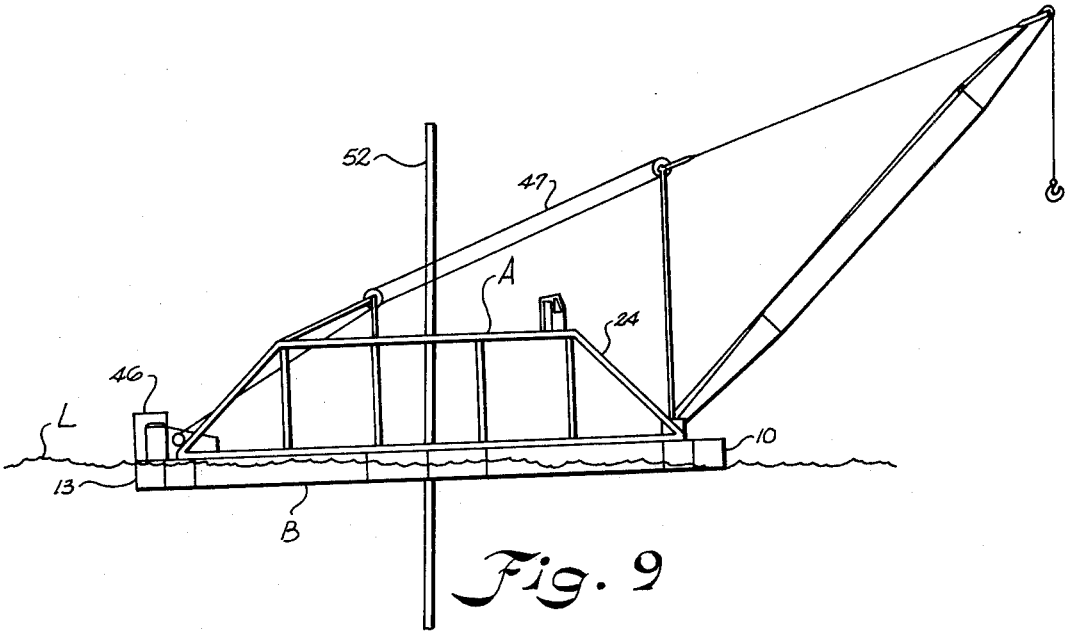
FIG. 9 is a side elevation illustrating the floating configuration of crane apparatus according to the invention when unloaded.
Figure 10:
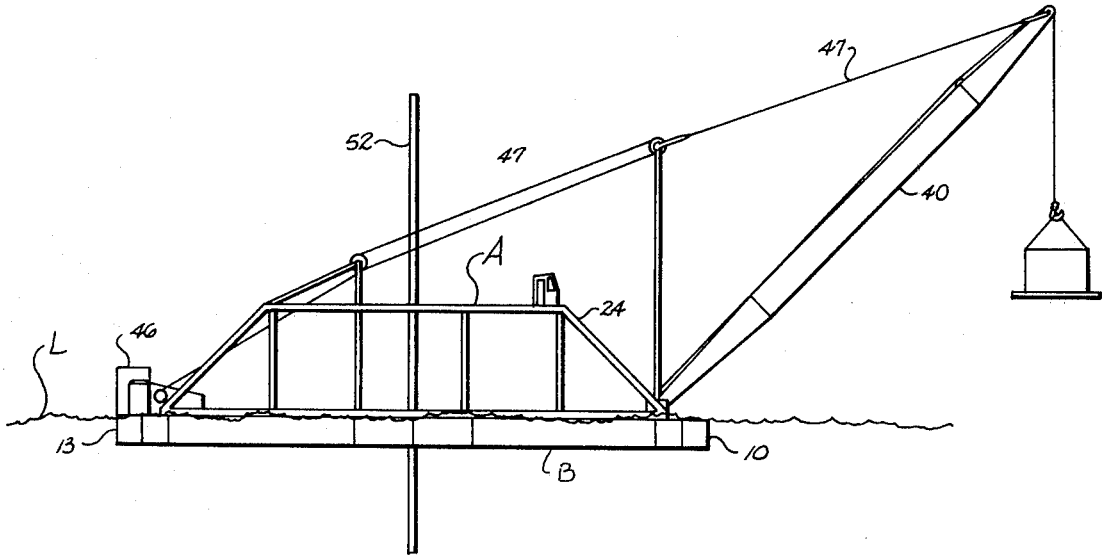
FIG. 10 is a side elevational view of floating crane apparatus according to the invention illustrating the floating configuration thereof when the boom is loaded at capacity.

Referring now to FIGS. 9 and 10, the floating crane apparatus will be described in terms of its operational configuration. With boom 40 unloaded, annular float assembly B is adjusted by leveling connection means C to assume a position wherein the rear pontoon member is at the water level L and the front pontoon member is above the water level L as illustrated. Annular float assembly B is designed and adjusted such that when the boom is operated at its load capacity, the front pontoon member 10 will be sunk to water level, as can best be seen in FIG. 10. Any waves approaching the float assembly will wash over the surface of the pontoon members, particularly forward pontoon 10, eliminating any additional lift on the boom, thus reducing any shock or sudden loads on the boom. Likewise, should the annular float assembly be rotated to move the boom laterally, little or no water will be displaced which together with reduced wave action results in a substantial reduction in dangerous side loading of the boom. In this configuration, it can be seen that the float assembly and crane apparatus operate in a self-leveling manner as they turn about spud 52.

Placing the hoist machinery on the rear as illustrated, on the aft pontoon member, is desirable so that the front pontoon member 10 will sit high in the water on the front whereby the annular float assembly may be designed and adjusted whereby the float assembly is at water level when the boom is operated at its capacity.

Thus, it can be seen that an advantageous construction can be had for a floating crane wherein an annular float assembly is designed to float at water level at boom load capacity providing a stable platform and is propelled to rotate thereby moving the crane boom and load laterally in a manner resulting in reduced boom side loading and increased maneuverability.

While a preferred embodiment of the invention has been described using specific terms, such description is for illustrative purposes only, and it is to be understood that changes and variations may be made without departing from the spirit or scope of the following claims.

What is claimed is:

1. Floating crane apparatus comprising:

an annular float assembly supporting said crane apparatus including pontoon means having a generally annular configuration which includes a medial opening;

frame means carried by said pontoon means in said annular configuration;

bridge means included in said frame means extending generally across said annular float assembly spanning said medial opening;

boom means operatively carried by said bridge means and said float assembly for movement in a generally vertical plane; and propulsion means carried by said float assembly for rotating said float assembly thereby moving said hoist boom means laterally in a unitary manner;

whereby a load may be laterally moved by said crane apparatus in a generally self-leveling manner with reduced side loading of said hoist boom means.

2. The apparatus of claim 1 wherein said pontoon means includes a plurality of individual pontoon members adapted for connection with one another in said annular configuration;

3. The apparatus of claim 2 wherein said bridge means extends generally between a forward and aft pontoon member, the remaining of said pontoon members being readily disconnectable for altering said annular configuration to facilitate transportation of said crane apparatus.

4. The apparatus of claim 2 wherein said frame means includes pivotal arm members interconnecting a number of pontoon members said pivotal arm members pivotably carried by said bridge means and being pivotable inwardly when said pontoon members are disconnected for transportation.

5. The apparatus of claim 1 including anchor means carried by frame means centrally of said annular float assembly in said medial opening providing a pivot about which said float assembly rotates.

6. The apparatus of claim 1 including spud anchor means having a spud post carried centrally in said medial opening about which said annular assembly turns for lateral boom movement which includes anchor means locking said spud post against rotation.

7. The apparatus of claim 1 including level adjusting means connected between said frame means and pontoon means facilitating adjustable spacing and pressure therebetween to thereby level the floatation attitude of said crane apparatus in the water.

8. Floating crane apparatus for supporting and moving loads comprising:

a plurality of pontoon members having detachable connection with one another;

frame means interconnecting said pontoon member in an annular configuration to define a generally annular float assembly having a medial opening;

bridge means included in said frame means extending generally between forward and aft pontoon members spanning said medial opening;

boom means carried by said annular float assembly operatively connected to said bridge means for vertical pivotal movement;

anchor pivot means carried by said float assembly adjacent said medial opening providing a pivot about which said annular float assembly turns;

propulsion means carried by said annular float assembly for producing a rotational thrust and rotating said float assembly about said anchor means, thereby moving said float assembly and boom means in a unitary manner to swing said boom means laterally; and said frame means including movable arm members having a first position connected to said pontoon members in said annular configuration and a second position in which a number of said pontoon members are nested between said forward and aft pontoon members facilitating transportation of said floating crane apparatus;

whereby a stable floating crane platform is provided affording reduced side loading of said boom means when loaded during lateral movement and which may be readily altered in configuration to facilitate transportation.

9. The apparatus of claim 8 including a plurality of main pontoon members and a plurality of intermediate pontoon members detachably connected therebetween, said propulsion means carried by said intermediate pontoon members arranged in said nested configuration to provide a linear thrust for transporting said floating crane apparatus.

10. The apparatus of claim 8 wherein said anchor means includes a spud anchor carried centrally in said medial opening.

11. The apparatus of claim 10 including collar means carried by said frame means, said spud anchor including a vertical spud post carried by said collar means, spaced spud blades for engaging terrain below the floating crane generally locking said spud anchor against rotation, and universal joint means connecting said spud blades and post ensuring engagement of said blades in uneven terrain.

12. The apparatus of claim 8 including leveling connection means connecting said movable arm members and respective pontoon members for adjusting the level of said arm members in relative connection to respective pontoon members so that adjustment of the water level of float of each pontoon member and, hence, attitude of the crane may be adjusted to level said apparatus in the water.

* * * * *